United States Patent [19]

Goh

[11] Patent Number: 4,662,769

[45] Date of Patent: May 5, 1987

[54] TUBULAR WRITING PEN TIP WITH ADJUSTMENT MEANS

[75] Inventor: Djing-San Goh, Hamburg, Fed. Rep. of Germany

[73] Assignee: Kob-I-Noor Rapidograph, Inc., Bloomsbury, N.J.

[21] Appl. No.: 736,726

[22] Filed: May 22, 1985

[30] Foreign Application Priority Data

May 22, 1984 [DE] Fed. Rep. of Germany ..... 3418954

[51] Int. Cl.[4] ..... B43K 17/00; B43K 1/10; B43K 3/04

[52] U.S. Cl. ..... 401/259; 401/116; 401/260

[58] Field of Search ..... 401/214, 224, 258, 259, 401/260, 199, 198, 209, 116

[56] References Cited

U.S. PATENT DOCUMENTS

| | | | |
|---|---|---|---|
| 231,690 | 8/1880 | Sutherland | 401/260 |
| 1,122,559 | 12/1914 | Wade | 401/258 |
| 3,468,611 | 9/1969 | Ward | 401/260 |
| 3,486,830 | 12/1969 | Bok | 401/260 |
| 3,535,050 | 10/1970 | Bok | 401/260 |
| 4,160,256 | 7/1979 | Dziuk | 401/260 |
| 4,390,299 | 6/1983 | Mutschler | 401/259 |

FOREIGN PATENT DOCUMENTS

| | | | |
|---|---|---|---|
| 1274929 | 7/1965 | Fed. Rep. of Germany . | |
| 1457459 | 9/1966 | France | 401/198 |
| 149734 | 9/1931 | Switzerland | 401/260 |
| 369981 | 7/1963 | Switzerland | 401/260 |
| 2063180A | 6/1981 | United Kingdom . | |

*Primary Examiner*—Steven A. Bratlie

*Attorney, Agent, or Firm*—David H. Semmes; Warren E. Olsen

[57] ABSTRACT

In a tip of a tubular writing pen having a writing tube (2) secured in a forepart a (1) joined to a pen body and an axially movable fluid conductor (3) extending into the writing tube, of the type wherein the projecting length of a writing fluid conductor (3), beyond the forward end of the writing tube (2), is adjustable. To this end, a writing pen tip forepart (1) is non-dislocatably joined to the pen body, while a coupler element (6) is secured about a portion of the writing fluid conductor (3), inside of the forepart. As the tubular writing pen tip is raised from the drawing surface, a surface of the coupler engages against a bearing surface of an adjuster element (7, 8). The adjuster element (7, 8) is in screw-like engagement with an axially non-dislocatable actuating socket (16), so that the adjuster element axially is shifted, simply by rotating the actuating socket (16).

15 Claims, 3 Drawing Figures

TUBULAR WRITING PEN TIP WITH ADJUSTMENT MEANS

BACKGROUND OF THE INVENTION (1) Field of the Invention

The present invention relates to a tip for a tubular writing pen having a writing tube secured in a forepart that is joined to a pen body. A writing fluid conductor, having a front end in contact with the drawing surface during use, is movable in the axial direction, and extends into the writing tube. The rearward end portion of the writing fluid conductor communicates with a reservoir of writing fluid. The projecting length of the writing fluid conductor beyond the front end of the writing tube is adjustable.

(2) Brief Description of the Prior Art

In a known tubular writing pen of this type (DE-PS No. 1 274 929), the forepart carrying the writing tube is screwed into the pen body, and the writing fluid conductor comprises a cleaning wire which is secured in the front end of a falling weight body. The falling weight body is supported, at its front end, upon appropriately embodied portions of the pen body, thereby fixing the length by which the cleaning wire projects beyond the front end of the writing tube. This projecting length can be adjusted during the assembly of the tubular writing pen, or after the front end of the cleaning wire has worn down, by changing the relative position of the forepart. The forepart can be screwed into or out of the pen body, by appropriately rotating the forepart.

In this known tubular writing pen it is possible to adjust the projecting length in a simple manner. However, impact stresses on the forepart are particularly prevalent when the tubular writing pen, or its tip, is used in a plotter, because the writing tube is applied repeatedly to the drawing surface. These stresses present a danger that the location of the forepart within the pen body will shift.

OBJECT AND SUMMARY OF THE INVENTION

Accordingly, it is an object of the invention to improve a tubular writing pen tip in such a way that impact stresses on the writing tube or the forepart will not result in a change in the projecting length of the writing fluid conductor beyond the front end of the writing tube.

To attain this object, a tubular writing pen tip of the generic type discussed above is embodied such that the forepart is joined to the pen body in a non-dislocatable way. A coupler element is provided on the writing fluid conductor which, when the pen is raised from the drawing surface, will be in engagement with the bearing surface of an adjuster element. The adjuster element is in screwed engagement with a rotatable actuating socket, which is retained in a non-dislocatable manner in the axial direction with respect to the forepart.

In a tubular writing pen tip according to the invention, the forepart receiving the writing tube is disposed in a non-dislocatable manner, that is, its position cannot be changed by impact stresses, while the location of the writing fluid conductor with respect to the writing tube is adjustable by means of an actuating socket and an adjuster element in screwed engagement with it. The actuating socket is rotatable but is non-dislocatable axially and with respect to the forepart. When the pen tip is raised from the drawing surface, the adjuster element limits the projecting length of the writing fluid conductor, beyond the front end of the writing tube, by presenting a bearing surface for a coupler element of the writing fluid conductor. This coupler element may, for instance, be a separate part that is attached to the writing fluid conductor, or it may be the front end of a falling weight body.

Thus, in a tubular writing pen tip according to the invention, the adjustment of the writing fluid conductor in the axial direction with respect to the writing tube is effected with the aid of structural parts, that do not change position due to impact stresses, acting upon the forepart.

If the writing fluid conductor of the tubular writing pen tip is not joined to a falling weight body, then the coupler element may be acted upon by a spring force that is exerted in the forward direction, so as to press the writing fluid conductor toward the front when the pen tip is raised from the drawing surface and causing its front end to project beyond the writing tube.

In order to guide and retain the adjuster element in a centered manner, a socket element may be provided which is embodied on either the pen body or the adjuster element, and which engages a receiving opening on the adjuster element or pen body, respectively.

In a preferred embodiment of the invention, the adjuster element may have at least one, and preferably two opposed protrusions, which extend through two axially extending parallel slits in the forepart. The outer faces of the protrusions are adapted to be in a screw-like engagement with an internal thread of an actuating socket, which is disposed to surround an outer surface of the forepart. In an arrangement of this kind, an axial shift of the nonrotatable adjuster element with respect to the actuating socket is effected by rotating an actuating socket, which itself is retained in an axially non-dislocatable manner. Hence, axial dislocation of a bearing surface for a coupler element attached to the writing fluid conductor is effected, thereby attaining an adjustment of the projecting length of the writing fluid conductor, beyond the front end of the writing tube.

In order to enable an incremental adjustment of the axial location of the writing fluid conductor tip in predetermined lengths, the adjusting element protrustions may be bifurcated at their ends. Each bifurcated end portion then is adapted to rest against either side of an individual thread of the internal thread of the actuating socket. Upper and lower faces of the thread support the bifurcated end portions by elastically compressing their opposing surfaces, while detent recesses are provided at selected positions over the course of the internal thread. As a result, as a pair of opposed detent recesses are reached, the bifurcated end portion of a protrusion elastically will spread apart, and extend into the detent recesses. In that way definite detent positions of the adjuster element are attained. For internal thread locations between adjacent detent recesses, a continuous shifting of the adjuster element is possible.

If the tubular writing pen tip has a pressure equalizing chamber, with one end communicating with the writing fluid reservoir and the other end communicating with ambient air, then the rear end of the forepart can be secured on the front end of the pen body which supports the pressure equalizing chamber, so that impacts acting upon the forepart are absorbed by this body. Alternatively a tampon ink reservoir, labyrinth ink regulator, or other fluid regulation systems may be used.

The invention will be explained in further detail in the ensuing description of an exemplary embodiment, taken in conjunction with the drawings.

DESCRIPTION OF THE PREFERRED EMBODIMENT

Figure 1:
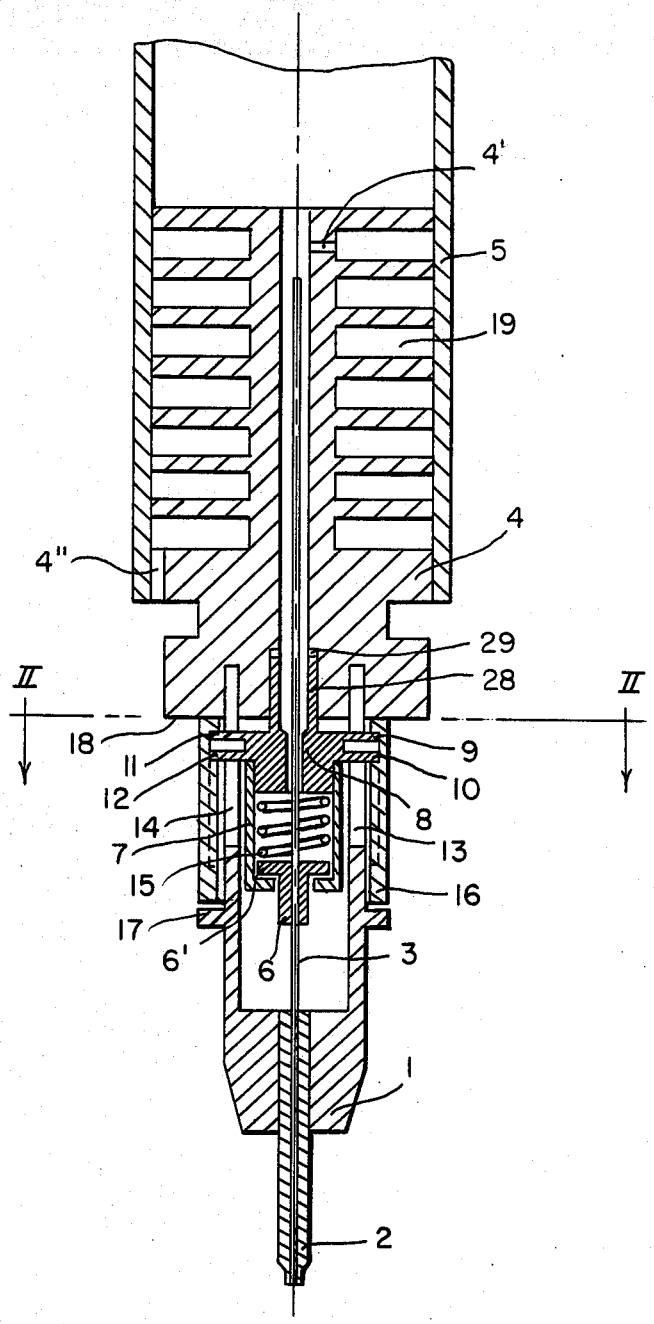
FIG. 1, in simplified, schematic form, shows a section taken through a tubular writing pen tip.
Figure 2:
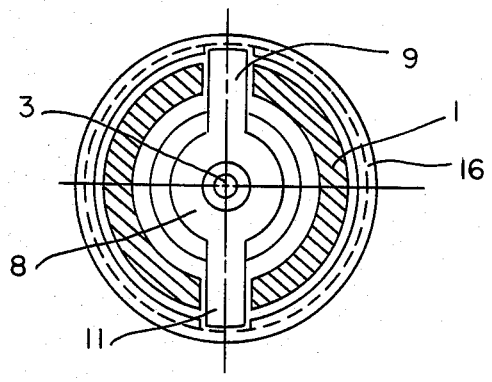
FIG. 2 shows a section taken along the line II—II of FIG. 1.

The tubular writing pen tip shows has a forepart 1, in the front end of which a writing tube 2 is secured. The rear end of the forepart 1 extends into an annular groove of a pen chamber body 4 and is nondislocatably secured in this annular groove by gluing, or the like. The chamber body 4 has a pressure equalizing chamber 19, shown in schematic form, the annular segments of which communicate with one another in a meandering manner, (not shown). The chamber communicates via a rear opening 4' with a writing fluid reservoir, and via a front groove 4'' with the ambient air. A writing fluid tank 5 (shown fragmentarily) embodies a writing fluid reservoir and is slipped onto the chamber body 4 in a sealing manner.

A writing fluid conductor 3 extends forward into the writing tube 2 through a continuous central conduit in the chamber body. The conduit communicates with the region of the writing fluid tank 5, above the chamber body 4. A writing fluid conductor of this kind may for example, be a capillary or 4'' metal wire or a capillary or extruded plastic element and serves in a known manner, when the writing tube 2 is applied to a drawing surface, to assure the flow of writing fluid out of the writing tube 2 onto the drawing surface. Such conductors are known also to form an annular capillary space within the writing tube 2, so that writing fluid flows out in a controlled manner, and does not drip from the writing tube tip, when the tube is raised from a drawing surface.

A cup-shaped coupler element 6 is secured to the writing fluid conductor 3 by clamping, gluing or the like such that it cannot be dislocated. When the pen tip is in the raised position, the flange 6' of the coupler element 6 is pressed toward the front by a spring 15 and/or by the falling right body of the coupler element 6. The rear end of the spring is supported against a transverse inner surface of adjuster element 8, and urges the flange 6 against an inwardly extending annular shoulder, the adjuster element 7. In this manner, the projecting length of the writing fluid conductor 3 beyond the front end of the writing tube 3 is fixed, relative to the position of adjuster element 7, 8.

The adjuster element preferably comprises a cup-shaped element 7 and a screw element 8, whereby the above-mentioned annular shoulder of the cup-shaped element 7 is a transverse inner surface of the cup, which in turn has an axial passageway opening. The two elements 7, 8 firmly are joined to one another, to define the adjuster element.

The screw element 8, has a transverse lower surface against which the top of spring 15 is supported, and pairs of bifurcated, lateral protrusion 9, 10 and 11, 12, which extend through opposed, axially extending parallel slits 13, 14 in the writing pen tip forepart 1. In surrounding relation to the slits 13, 14, there is an actuating socket 16 having an internal thread, with a front end that rests at an annular shoulder 17 upon the forepart, 1, and a rear end which rests at a front end face 18 of the chamber body 4. The actuating socket 16 thereby is held in an axially, non-dislocatable manner. The outer faces of protrusions 9, 10 and 11, 12 are in screwed engagement with the internal thread of the actuating socket 16.

Screw element 8 further comprises an extension 28, which is molded onto the rear end of the screw element 8, and extends into a bore 29 of the chamber body 4 for a sliding engagement with the circumferential inside of bore 29 wall.

If the actuating socket 16 is rotated, the axial non-dislocatability of the actuating socket 16 causes a corresponding, axial shift of the adjuster element 7, 8 together with the flange bearing surface 6' of the coupler element 6. The sliding engagement between screw element extension 28 and bore 29 keeps the screw element 8 centered, with respect to the chamber body 4. In this manner, the projecting length of the writing fluid conductor 3 beyond the writing tube 2 can be adjusted, or later readjusted after some wear has taken place.

As readily will be appreciated, impact stresses imposed upon the writing tube 2, for instance when the tubular writing pen tip is lowered during use in a plotter, will be transmitted by the writing tube 2, only through the forepart 1 and on to the chamber body 4. Hence, no impact stresses (and attendant shifting) will be transmitted to coupler element 6, adjuster element 7, 8 or to actuating socket 16; all being the elements which determine the projected length of the writing fluid conductor 3.

Figure 3:
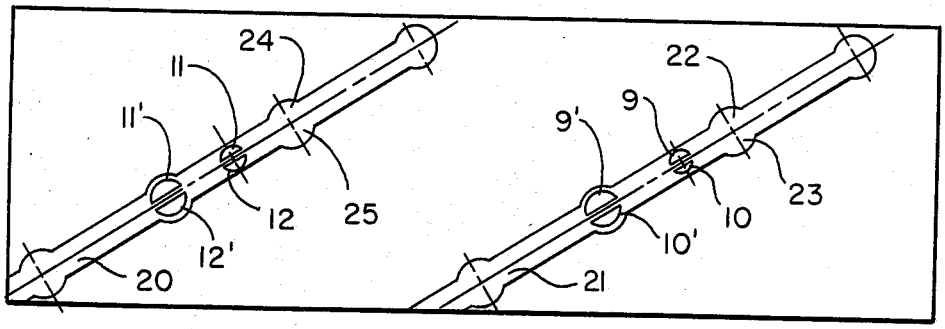
FIG. 3 is a schematic representation of a development of the internal thread of the actuating socket.

As already mentioned above, the protrusions 9, 10 and 11, 12 of the screw element 8 of the adjuster element 7, 8 are bifurcated. These bifurcated end portions rest one on each side of one thread, as for the thread courses 20, 21 of FIG. 3. The bifurcated end portions are elastically compressed by the adjacent wall surfaces of the internal thread. As also shown in FIG. 3, pairs of detent recesses, such as recesses 22, 23 and 24, 25 are provided in opposed locations. Therefore, as the actuating socket 16 is rotated, the bifurcated end portions 9, 10 and 11, 12 of the screw element 8 reach the vicinity of these recesses, and the recesses allow the bifurcated ends to spread apart, as shown by the protrusions 9', 10' and 11', 12', in FIG. 3. The user, therefore, notices clearly perceptible detent positions. As a result, adjustment of the projecting length of the writing fluid conductor 3, by predetermined increments, is facilitated, with increments being determined by the spacing between successive detent recesses.

While a preferred embodiment has been shown and described, the invention solely is to be limited in the scope of the appended claims:

I claim:

1. In a tubular writing pen having a writing tube secured in a writing pen tip forepart which is joined at the rear to a pen body, a writing fluid conductor which is movable axially and extends within the writing tube and has a front end that is in contact with a drawing surface while in use and a rearward end portion which communicates with a reservoir of writing fluid wherein, further, the projection length of the writing fluid conductor beyond the front end of the writing tube is adjustable, the improvement which comprises, in combination, a writing pen tip forepart (1) joined in a non-dislocatable manner to the pen body, a coupler element (6)

secured to a portion of the writing fluid conductor (3) proximate said forepart and adapted to engage with an adjuster element (7, 8) that axially is adjustable by means of a screw-like engagement between at least one adjuster element lateral protrusion (9, 10, 11, 12) and a surrounding rotatable actuating socket (16), that is rotatable but is retained non-dislocatably in the axial direction with respect to the forepart (1), and coupler element engagement means to engage a surface of said coupler element with a bearing surface of said adjuster element in the state pen tip being raised above a drawing surface, whereby external rotation of the socket (16) axially adjusts the coupler element engagement means.

2. In a tubular writing pen tip according to claim 1, wherein said coupler element engagement means comprises a spring which engages against a portion of said adjuster element and urges said coupler element in a forward direction, against another surface of said adjuster element.

3. In a tubular writing pen tip according to claim 1 wherein said adjuster element (8) further comprises a screw element extension (28) which axially slides within a pen body bore, in order to retain said adjuster element (7, 8) in a centered manner.

4. In a tubular writing pen tip according to claim 2, wherein said adjuster element (8) further comprises a screw element extension (28) which axially slides within a pen body bore, in order to retain said adjuster element (7, 8) in a centered manner.

5. In a tubular writing pen tip according to claim 1, wherein the adjuster element (7, 8) has at least one lateral protrusion (9, 10; 11, 12), which extends through an axially parallel slit (13, 14) within the forepart (1), wherein further, outer faces of a distal end of said protrusion (9, 10; 11, 12) are in screw-like engagement with an internal thread defined within an actuating socket (16), that is disposed in a surrounding relation about an outer surface portion of the forepart (1).

6. In a tubular writing pen tip according to claim 2, wherein the adjuster element (7, 8) has at least one lateral protrusion (9, 10; 11, 12), which extends through an axially parallel slit (13, 14) within the forepart (1), wherein further, outer faces of a distal end of said protrusion (9, 10; 11, 12) are in screw-like engagement with an internal thread defined within an actuating socket (16), that is disposed in a surrounding relation about an outer surface portion of the forepart (1).

7. In a tubular writing pen according to claim 3, wherein the adjuster element (7, 8) has at least one lateral protrusion (9, 10; 11, 12), which extends through an axially parallel slit (13, 14) within the forepart (1), wherein further, outer faces of a distal end of said protrusion (9, 10; 11, 12) are in screw-like engagement with an internal thread defined within an actuating socket (16), that is disposed in a surrounding relation about an outer surface portion of the forepart (1).

8. In a tubular writing pen according to claim 5, wherein two opposing protrusions (9, 10; 11, 12) are provided.

9. In a tubular writing pen according to claim 6, wherein two opposing protrusions (9, 10; 11, 12) are provided.

10. In a tubular writing pen according to claim 7, wherein two opposing protrusions (9, 10; 11, 12) are provided.

11. In a tubular writing pen according to claim 5, wherein at least one protrusion (9, 10; 11, 12) is bifurcated and a bifurcated end portion (9, 10; 11, 12) rests on either side of opposing wall surfaces defining said internal thread, wherein upper and lower thread wall surfaces support the bifurcated end portions (9, 10; 11, 12) in an elastically compressed manner while in the course of the internal thread, detent recesses (22, 23; 24, 25) are provided to allow the bifurcated end portions to spread apart.

12. In a tubular writing pen according to claim 8, wherein at least one protrusion (9, 10; 11, 12) is bifurcated and a bifurcated end portion (9, 10; 11, 12) rests on either side of opposing wall surfaces defining said internal thread, wherein upper and lower thread wall surfaces support the bifurcated end portions (9, 10; 11, 12) in an elastically compressed manner while in the course of the internal thread, detent recesses (22, 23; 24, 25) are provided to allow the bifurcated end portions to spread apart.

13. In a tubular writing pen according to claim 1, further characterized by a pressure equalizing chamber with one end in communication with the writing fluid reservoir which may further comprise, a tampon fluid reservoir, labyrinth ink regulator or the like, and the other end in communication with ambient air, the further improvement wherein a rearward end of said writing tip forepart (1) is secured on a forward end of the body (4) which encompasses the pressure equalizing chamber (19).

14. It is a tubular writing pen according to claim 2, further wherein by a pressure equalizing chamber with one end in communication with the writing fluid reservoir and the other end in communication with ambient air, the further improvement wherein a rearward end of said writing tip forepart (1) is secured on a forward end of the body (4) which encompasses the pressure equalizing chamber (19).

15. In a tubular writing tip according to claim 1, wherein said coupler element engagement means comprises a coupler element which is a falling weight body, which is urged by gravity in a forward direction, and into contact with a surface of said adjuster element.

* * * * *